United States Patent [19]

Plyler et al.

[11] Patent Number: 4,950,175

[45] Date of Patent: Aug. 21, 1990

[54] ELECTRICAL CONNECTOR

[75] Inventors: Robert G. Plyler, Vienna; Lyle B. Suverison, Fowler; John A. Yurtin, Southington; Joseph H. Gladd, Cortland, all of Ohio

[73] Assignee: General Motors Corporation, Detroit, Mich.

[21] Appl. No.: 403,955

[22] Filed: Sep. 7, 1989

[51] Int. Cl.[5] ..... H01R 13/52

[52] U.S. Cl. ..... 439/274; 439/281

[58] Field of Search ..... 439/281, 272, 274, 275, 439/279, 271, 273, 277, 278, 587, 588, 589, 280, 282

[56] References Cited

U.S. PATENT DOCUMENTS

| | | | |
|---|---|---|---|
| 4,150,866 | 4/1979 | Snyder et al. | 339/94 |
| 4,173,349 | 11/1979 | Neale, III | 439/279 |
| 4,311,355 | 1/1982 | Plyler et al. | 339/94 |
| 4,491,376 | 1/1985 | Gladd et al. | 339/9E |
| 4,560,219 | 12/1985 | Chapelot | 439/272 |
| 4,640,567 | 2/1987 | Lundergan et al. | 439/271 |
| 4,708,413 | 11/1987 | Schroeder | 439/358 |
| 4,711,509 | 12/1987 | Cross et al. | 439/587 |
| 4,746,306 | 5/1988 | Yurtin et al. | 339/357 |
| 4,768,970 | 9/1988 | Nestor | 439/278 |
| 4,826,452 | 5/1989 | Sian et al. | 439/595 |

FOREIGN PATENT DOCUMENTS

| | | | |
|---|---|---|---|
| 72104 | 2/1983 | European Pat. Off. | 439/271 |

OTHER PUBLICATIONS

ITT CANNON SLE Series Catalog Dated 1986.

*Primary Examiner*—Gary F. Paumen

*Attorney, Agent, or Firm*—F. J. Fodale

[57] ABSTRACT

An electrical connector comprises a connector body and an elastomeric seal of one piece construction which seals the conductor end of the connector body and provides an interface seal when the connector body is plugged into a mating connector. The elastomeric seal is held in place by a backshell which provides a protective shroud for the interface sealing portion of the elastomeric seal. A lock arm is incorporated into the backshell which also provides a strain relief and a mount for a connector position assurance device.

10 Claims, 2 Drawing Sheets

ELECTRICAL CONNECTOR

BACKGROUND OF THE INVENTION

This invention relates generally to electrical connectors and more specifically to sealed electrical connectors.

The U.S. Pat. No. 4,711,509 granted to William E. Cross et al Dec. 8, 1987 discloses a sealed electrical connector which has a conductor seal pad 18 of synthetic rubber or the like and an elastomeric seal ring 20 mounted on a thermoplastic connector body 16. Terminals 24 attached to insulated conductors 26 are inserted into terminal cavities 30 of the connector body 16 through sealing apertures 19 of the conductor seal pad 18. As the terminals 24 are inserted, the inner flexible lips 54 of the elastomeric seal ring 20 engage and bias tubular contacts 50 of the terminals 24 downwardly into forward channels 42 of the terminal cavities 30. The elastomeric seal ring 20 temporarily retains the fully inserted terminals 24 until a cap member 22 is mounted on the nose portion 32 of the connector body 16 so that terminals 24 are then accurately located and securely retained in the terminal cavities 30 by a solid plastic part. The elastomeric seal ring 20 also has a number of flexible radially outward lips 64 which provide an interface seal.

SUMMARY OF THE INVENTION

The object of this invention is to provide an improved sealed electrical connector of the above noted type.

A feature of the invention is that the electrical connector has a connector seal which is a one-piece elastomeric part which seals at the conductor end of the connector body as well as provides an interface seal when the connector body is plugged into a mating connector body.

Another feature of the invention is that the electrical connector has a backshell which holds the elastomeric seal in place on the connector body so that the elastomeric seal does not become dislodged particularly when the connector body is being plugged into a mating connector body.

Another feature of the invention is that the backshell has guide holes which provide alignment when the terminals are being plugged into the terminal cavities through the sealing apertures of the elastomeric seal.

Another feature of the invention is that the backshell has a forward shroud which protects the interface sealing portions of the elastomeric seal during handling and which acts to align the electrical connector when it is plugged into a mating connector body.

Another feature of the invention is that the connector body has extensions which hold the elastomeric seal in place when the terminals are being plugged into the terminal cavities through the sealing apertures in the elastomeric seal.

Yet another feature of the invention is that the elastomeric seal and its circumferential sealing lips are tapered inwardly in the forward direction to reduce mating force requirements.

Yet another feature of the invention is that the nose portion of the connector body itself is configured to hold the terminals down in the channels until the cap is assembled.

Still yet another feature of the invention is that the cap is configured to protect the front end of the elastomeric seal during the mating operation.

Still yet another feature of the invention is that a lock arm for locking the electrical connector to a mating connector is incorporated into the backshell so that the backshell eliminates the need for a latch on the connector body thereby providing a strain relief for the connections at the terminal conductor interface.

Still yet another feature of the invention is that the backshell has provisions for receiving a connector position device which insures proper locking of the lock arm and prevents disengagement of a properly locked lock arm.

Other objects and features of the invention will become apparent to those skilled in the art as disclosure is made in the following detailed description of a preferred embodiment of the invention which sets forth the best mode of the invention contemplated by the inventors and which is illustrated in the accompanying sheet(s) of drawing.

DETAILED DESCRIPTION OF THE PREFERRED EMBODIMENT

Figure 1:
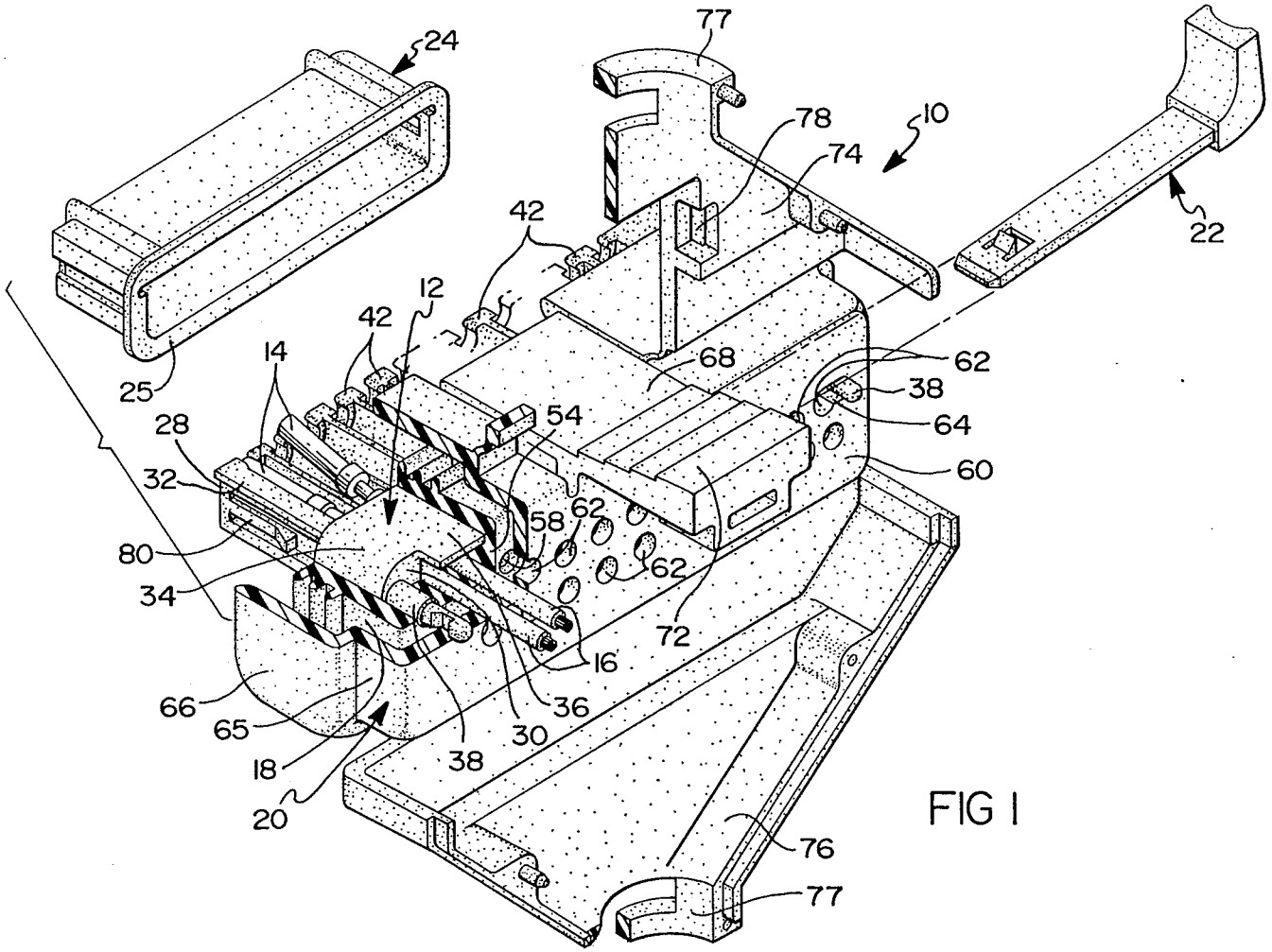
FIG. 1 is an exploded perspective view of an electrical connector in accordance with the invention.

Referring now to the drawing and more particularly to FIG. 1, an electrical connector in accordance with this invention is indicated generally at 10. The electrical connector 10 comprises a thermoplastic connector body 12, a plurality of electrical terminals 14 which are attached to a plurality of insulated conductor wires 16, an elastomeric seal 18, a thermoplastic backshell 20, a connector position assurance device 22 and a thermoplastic cap 24.

Figure 2:
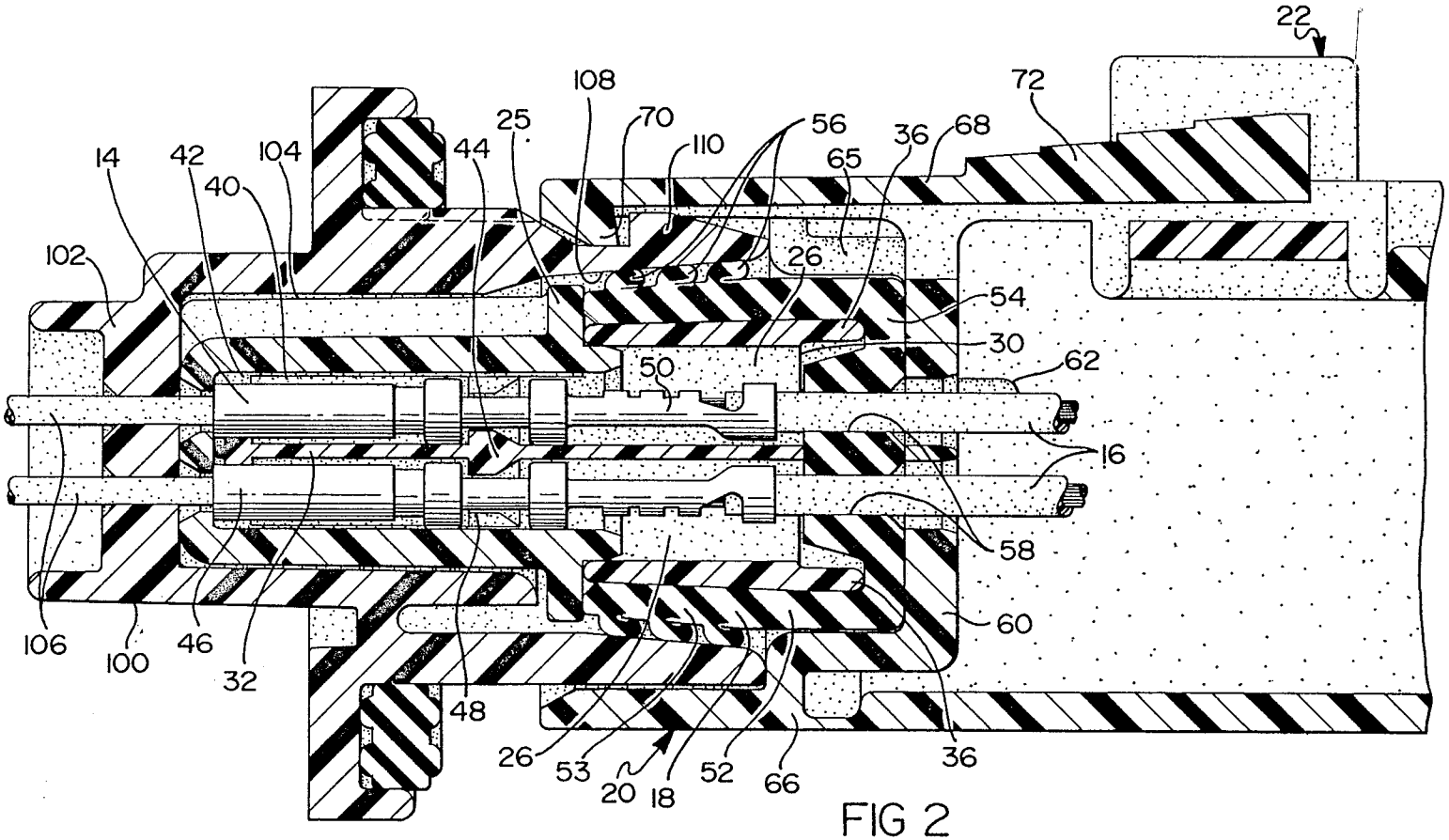
FIG. 2 is a longitudinal sectional view of mated electrical connectors including the electrical connector which is shown in FIG. 1.

The connector body 12 has a plurality of terminal cavities 26 which extend axially through the connector body from a forward contact end 28 to a rearward conductor end 30. The connector body 12 has a nose portion 32 of reduced height at the contact end 28 and a tapered medial portion 34 which tapers inwardly in the forward direction at an angle of about 2 degrees as best shown in FIG. 2. The connector body 12 also has upper and lower extensions 36 and lock posts 38 at the rearward conductor end 30.

The terminal cavities 26 have rearward portions which are of oval cross section and elongated in the vertical direction as shown in FIG. 2. The nose portion 32 comprises a plurality of ribs defining a channel 40 at the forward portion of each terminal cavity 26. Each terminal cavity 26 has a catch 42 at the forward end of its channel to hold the terminal 14 down in the channel and a wedge shaped lock shoulder 44 near the rearward end of its channel for retaining the terminal 14 in the terminal cavity and prevent it from being pulled out the rearward conductor end 30.

One of the terminals 14 is disposed in each terminal cavity 26. Each terminal 14 has a tubular receptacle 46 at its forward end, a circumferential retention groove 48 intermediate its ends and conventional crimp wings 50 at its rearward end which attach the terminal 14 to its associated insulated conductor wire 16.

The elastomeric seal 18, which is preferably made of a silicone rubber, is fitted over the medial portion 34 and extensions 36 at the conductor end 30 of the connector body 12. The elastomeric seal 18 comprises an annular wall 52 and a back wall 54 which has two internal lateral grooves receiving the extensions 36. The annular wall 52 has a forward tapered portion 53 which tapers inwardly in the forward direction. The tapered portion 53 fits snugly on the tapered medial portion 34 of the connector body 12 and it has a plurality of circumferential sealing lips 56 which are in tapered pattern. The forward tapered portion 53 has an internal taper of approximately 2 degrees and an external taper of about 5 degrees. The tapered pattern of the circumferential sealing lips 56 is such that their tips lie in an imaginary line or surface which also has a taper of about 5 degrees when the sealing lips 56 are in their free undeflected state. Thus the forward sealing lip has a height which is less than that of the middle sealing lip whose height in turn is less than that of the rear sealing lip. The sealing lips 56 are adapted to provide an interface seal when the connector body 12 is plugged into a mating connector body and the sealing lips 56 are deflected as shown in FIG. 2.

The back wall 54 of the elastomeric seal 18 has a plurality of sealing apertures 58 which are aligned with the terminal cavities 26 and the lock posts 38. The apertures 58 are sized so that the back wall 54 seals around the insulated conductor wires 16 and the lock posts 38 which project through the apertures 58 when elastomeric seal 18 is mounted on the connector body 12 and the terminals 14 are inserted into the terminal cavities 26. Thus the elastomeric seal 18 also seals the conductor end 30 of the connector body 12.

The backshell 20 is fitted over the elastomeric seal 18 and attached to the rearward conductor end of the connector body 12 by the lock posts 38 in order to retain the elastomeric seal 18 in place. The backshell 20 has a back wall 60 which is juxtaposed the back wall 58 of the elastomeric seal 18 and which has a plurality of guide holes 62 which are aligned with the sealing apertures 58 of the elastomeric seal 18 and the terminal cavities 26 of the connector body 12. The guide holes 62 are used to guide the terminals 14 into the terminal cavities 26 through the sealing apertures 58 of the elastomeric seal 18. The guide holes 62 are larger than the sealing apertures 58 so that the terminals 14 are freely inserted through the guide holes 62.

The back wall 60 of the backshell 20 also has two latch holes 64 which receive and cooperate with the lock posts 38 to secure the backshell 20 to the connector body 12. The two latch holes 64 are merged with two of the guide holes 62 as shown in FIG. 1.

The backshell 20 has an annular support wall 65 adjoining the back wall 60 which fits closely around the rearward portion of the annular wall 52 of the elastomeric seal 18. This annular support wall 56 provides radial support for the elastomeric seal 18 and prevents roll up when the electrical connector 10 is plugged into a mating connector.

The backshell 20 also has a forward shroud 66 which is spaced radially outwardly of the annular support wall 65 and the circumferential sealing lips 56 when the sealing lips 56 are in a free undeflected state. The shroud 66 extends forwardly of the elastomeric seal 18 to protect the elastomeric seal 18 during handling.

The backshell 20 further includes a lock arm 68 which is attached to the back wall 60 by an integral hinge. The lock arm 68 has a catch 70 which is forward of the hinge and a handle 72 which extends rearwardly of the hinge so that the handle 72 pivots the catch 70 outwardly about the integral hinge when the handle 72 is depressed.

The backshell 20 has an end bell for gathering the insulated conductors 16 into a bundle which comprises upper and lower clam shells 74 and 76 which are integrally hinged to the back wall of the backshell 20. The clam shells 74 and 76 move between an open position providing access to the back wall 60 of the backshell 20 as shown in FIG. 1 and a closed position shown in FIG. 2. In the closed position, the ends 77 of the clam shells 74 and 76 cooperatively form a collar which embraces the conductor wires 16.

The upper clam shell 74 has a slot 78 on each side of the lock arm 68. The slots 78 of the upper clam shell 74 receive the shank of connector position assurance device 22 when the clam shells 74 and 76 are in the closed position and the lock arm 68 is correctly positioned to lock the electrical connector 10 to its mating electrical connector as shown in FIG. 2. The connector position assurance device 22 also prevents depression of the handle 72 and the unlocking of the lock arm 68 after the electrical connector 10 is properly connected to its mating electrical connector.

The cap 24 is fitted over the nose portion 32 of the connector body 12 and retained in place by latch arms 80 at the forward end of the connector body 12.

The electrical connector 10 is assembled in the following manner. The elastomeric seal 18 is fitted over the conductor end of the connector body 12 as shown in FIG. 1. This elastomeric seal 18 provides both a conductor seal and an interface seal as explained above. The backshell 20 is then fitted over the elastomeric seal 18 and secured in place by the lock posts 38 which snap through the lock holes 64 to engage the outer surface of the back wall 60. When secured in place the back wall 60 of the backshell 20 fits snugly against the back wall 54 of the elastomeric seal 18 which in turn fits snugly against the extensions 36 of the connector body 12 and the annular support wall 65 fits closely around the annular wall 52 as shown in FIG. 2.

The clam shells 74 and 76 are placed in the open position as shown in FIG. 1 and the terminals 14 are then plugged into the connector body 12 through the guide holes 62 in the exposed back wall of the backshell 20. The terminals 14 fit freely through the guide holes 62 which guide the terminals 14 into the sealing apertures 58 which extend through the back wall 54 of the elastomeric seal 18. As the terminals 14 are plugged in to the terminal cavities 26 through the sealing apertures 58, the extensions 36 of the connector body 12 hold the elastomeric seal 18 in place. This permits the sealing apertures 58 to stretch open in tension lowering the insertion force required and preventing damage to the elastomeric seal 18.

When the front end of the terminal 14 reaches the channel 40 of the terminal cavity 12, the terminal 14 is cammed upwardly over the wedge shaped lock shoulder 44 until the terminal is fully inserted into the terminal cavity 26. The front end of the terminal 14 is then snapped down into the channel 40 past the catch 42 which retains the front end of the terminal 14 in the channel 40. At this time the wedge shaped lock shoulder 44 enters the circumferential retention groove 48 to retain the terminal 14 in the axial direction.

When all the terminals 14 are inserted into their respective terminal cavities 26, the cap 24 is mounted and retained on the nose portion 32 of the connector body 12 as shown in FIG. 2. The cap 24 has a rearward flange 25 which protects the front of the elastomeric seal 18. The clam shells 54 and 56 are then closed and retained in the closed position by cooperating catch pins and apertures in the perimeters of the clam shells. The closed clam shells 54 and 56 have an exit collar for the insulated conductor wires 16 formed by the semi-circular end portions 77 of the respective clam shells.

In use the electrical connector 10 is plugged into a mating electrical connector such as the header connector 100 which is shown in FIG. 2. The header connector 100 comprises an insulator body 102 which has a socket 104 and which is typically attached to a printed circuit board (not shown). The header connector 10 further comprises a plurality of pin terminals 106 which have one end soldered or otherwise suitably electrically connected to conductors of the printed circuit board and the other end projecting into the socket 104 for engagement with the terminals 14. The socket 104 has an internal sealing surface 108 which tapers outwardly toward the open end of the socket 104 and an external lock projection 110 which cooperates with the catch 70 of the electrical connector 10.

When the electrical connector 10 is mated to the header connector 100, the force required to deflect the sealing lips 56 is applied more gradually because the sealing lips 56 and the sealing surface 108 are both tapered.

When the electrical connector 10 is completely mated to the header connector 100, the catch 70 of the lock arm 68 engages the lock projection 110 to lock the connectors together. The connector position assurance device 22 is then inserted into the slots 78 of the closed upper clam shell 74. The insertion of device 22 assures that the electrical connectors 10 and 100 are properly locked together and also prevents depression of the handle 72 and the consequent unintentional disconnection.

We wish it to be understood that we do not desire to be limited to the exact details of construction shown and described, for obvious modifications will occur to a person skilled in the art.

The embodiments of the invention in which an exclusive property or privilege is claimed are defined as follows:

1. An electrical connector comprising:

a connector body having a plurality of terminal cavities extending axially through the connector body from a forward contact end to a rearward conductor end, an elastomeric seal mounted on the rearward conductor end of the connector body, the elastomeric seal having an annular wall which includes a circumferential sealing lip which is adapted to provide an interface seal between the connector body and to a mating connector body, the elastomeric seal having a back wall which seals the terminal cavities at the conductor end of the connector body, the back wall having a plurality of apertures which are aligned with the respective terminal cavities of the connector body and which are adapted for sealing around insulated conductor wires which project out of the terminal cavities at the conductor end of the connector body, and a backshell which is attached to the rearward conductor end of the connector body over the elastomeric seal to retain the elastomeric seal, backshell having a back wall which is juxtaposed to the back wall of the elastomeric seal and which has a plurality of guide holes which are aligned with the apertures of the elastomeric seal and the terminal cavities of the connector body for guiding terminals attached to insulated conductor wires into the respective terminal cavities via the apertures of the elastomeric seal.

2. The electrical connector as defined in claim 1 wherein the backshell has an annular wall adjoining the back wall which fits closely around the annular wall of the seal to prevent roll up when the electrical connector is plugged into a mating connector.

3. The electrical connector as defined in claim 1 wherein:

the connector body has upper and lower extensions which engage the back wall of the elastomeric seal, and the back wall of the elastomeric seal has internal slots which receive the upper and lower extensions.

4. The electrical connector as defined in claim 1 wherein:

the circumferential sealing lip of the elastomeric seal extends radially outwardly and the backshell has a forward shroud portion which is configured to protect the circumferential sealing lip during handling.

5. The electrical connector as defined in claim 1 wherein:

the connector body has a tapered medial portion which tapers inwardly in the forward direction, the annular wall of the elastomeric seal has a tapered portion which is mounted on the tapered medial portion of the connector body, and the circumferential sealing lip extends radially outwardly of the tapered portion of the elastomeric seal.

6. The electrical connector as defined in claim 1 wherein:

the elastomeric seal has a plurality of circumferential sealing lips which in their free undeflected state have tips which lie in an imaginary surface which tapers inwardly in the forward direction.

7. The electrical connector as defined in claim 6 wherein:

the tapered portion of the elastomeric seal has the plurality of circumferential sealing lips.

8. The electrical connector as defined in claim 1 wherein:

the backshell member has a lock arm.

9. An electrical connector comprising:

a connector body having a plurality of terminal cavities extending axially through the connector body from a forward contact end to a rearward conductor end, an elastomeric seal sealing the conductor end of the connector body and having a plurality of apertures which are aligned with the respective terminal cavities of the connector body for sealing around insulated conductor wires which project out of the terminal cavities at the conductor end of the conductor body, a backshell which is attached to the connector body seal to retain the elastomeric seal against the conductor end of the connector body, the backshell having a back wall which is juxtaposed to the elastomeric seal and which has a plurality of guide holes which are aligned with the apertures of the elastomeric seal and the terminal cavities of the connector body for receiving the insulated conductor wires which project out of the terminal cavities, and the backshell having a lock arm for locking the electrical connector to a mating electrical connector.

10. The electrical connector as defined in claim 9 wherein:

the lock arm is attached to the back wall of the backshell by an integral hinge, the lock arm has a forward catch and a rearward handle which pivots the forward catch outwardly about the integral hinge when the rearward handle is depressed, the backshell has upper and lower clam shells which are integrally hinged to the back wall of the backshell to move between an open position providing access to the back wall of the backshell and a closed position where the clam shells cooperatively form a collar embracing the insulated conductor wires, and one of the clam shells is configured to receive a connector position assurance device which is mounted on the one clam shell when it is in the closed position to assure that the lock arm is correctly positioned in its locked mating position and to prevent depression of the rearward handle when the lock arm is correctly positioned in the locked mating position.

* * * * *